US011873595B2

(12) United States Patent
Cohen et al.

(10) Patent No.: US 11,873,595 B2
(45) Date of Patent: Jan. 16, 2024

(54) EZE-PACK LAUNDRY HAMPER

(71) Applicant: Harsa Studio Ltd., Barkan (IL)

(72) Inventors: Yehuda Cohen, Moshav Timorim (IL); Refael Minyan, Gedera (IL)

(73) Assignee: Harsa Studio Ltd, Barkan (IL)

( * ) Notice: Subject to any disclaimer, the term of this patent is extended or adjusted under 35 U.S.C. 154(b) by 154 days.

(21) Appl. No.: 17/676,159

(22) Filed: Feb. 20, 2022

(65) Prior Publication Data

US 2022/0275569 A1 Sep. 1, 2022

Related U.S. Application Data

(60) Provisional application No. 63/154,900, filed on Mar. 1, 2021.

(51) Int. Cl.
*D06F 95/00* (2006.01)

(52) U.S. Cl.
CPC ..... *D06F 95/002* (2013.01)

(58) Field of Classification Search
CPC ..... D06F 95/002; D06F 95/004; A47G 29/20; A47G 29/141; A47G 29/2029; B65D 7/26; B65D 9/14; B65D 15/24; B65D 11/1853; B65D 21/086
USPC ..... 232/1 B
See application file for complete search history.

(56) References Cited

U.S. PATENT DOCUMENTS

| | | | | |
|---|---|---|---|---|
| 1,972,483 | A * | 9/1934 | Hartson | B65D 7/26 220/6 |
| 5,242,074 | A | 9/1993 | Conaway et al. | |
| D353,237 | S | 12/1994 | Banker | |
| 5,671,858 | A * | 9/1997 | Hsu | B65D 11/18 220/9.4 |
| D394,532 | S | 5/1998 | Burgin et al. | |
| D474,316 | S | 5/2003 | Sofy et al. | |
| D532,568 | S * | 11/2006 | Rodriguez | D32/37 |
| D643,583 | S | 8/2011 | Duvigneau | |
| D706,507 | S | 6/2014 | Duvigneau | |
| D732,778 | S | 6/2015 | Taulman | |
| D839,523 | S | 1/2019 | Duvigneau | |
| D880,795 | S | 4/2020 | Barre et al. | |
| 10,743,695 | B1 * | 8/2020 | Altmaier | B60R 9/065 |
| D927,811 | S | 8/2021 | Simonetti | |
| D978,465 | S | 2/2023 | Mazor | |
| 2005/0230390 | A1 | 10/2005 | Glenn | |
| 2012/0111861 | A1 * | 5/2012 | Nemoto | B65D 11/1853 220/6 |
| 2012/0187118 | A1 * | 7/2012 | Glenn | B65D 15/22 220/6 |

(Continued)

FOREIGN PATENT DOCUMENTS

| | | |
|---|---|---|
| GB | 6130649 | 4/2021 |

OTHER PUBLICATIONS

Office Action dated Apr. 11, 2023 for Design U.S. Appl. No. 29/764,706, filed Dec. 31, 2020.

(Continued)

*Primary Examiner* — William L Miller
(74) *Attorney, Agent, or Firm* — A.C. Entis-IP Ltd; Allan C. Entis

(57) ABSTRACT

A foldable laundry hamper having a folded and unfolded state, and in the folded state a floor panel and a cover of the hamper are sandwiched between the front and back panels and the hamper occupies a relatively small volume.

8 Claims, 8 Drawing Sheets

(56) References Cited

U.S. PATENT DOCUMENTS

| | | | | |
|---|---|---|---|---|
| 2013/0270131 | A1* | 10/2013 | Shieh | D06F 95/002 206/278 |
| 2014/0117072 | A1* | 5/2014 | Cullen | B65D 5/62 229/117.05 |
| 2018/0296016 | A1* | 10/2018 | Teoh | A47G 29/20 |
| 2019/0092525 | A1* | 3/2019 | Sawachi | B65D 25/2841 |
| 2019/0225375 | A1* | 7/2019 | Sena | A47G 29/20 |
| 2020/0048824 | A1 | 2/2020 | Bachoo | |
| 2021/0339905 | A1* | 11/2021 | Darkwah | E05B 65/52 |
| 2021/0361104 | A1* | 11/2021 | McLean | B65D 15/24 |
| 2022/0008578 | A1* | 1/2022 | Raphael | A47G 29/141 |
| 2022/0010481 | A1 | 1/2022 | Kaloydis | |
| 2022/0089317 | A1* | 3/2022 | Aliahmad | A47G 29/20 |
| 2022/0127043 | A1 | 4/2022 | Hsu | |
| 2022/0194659 | A1* | 6/2022 | Xiao | B65D 25/06 |
| 2022/0257041 | A1* | 8/2022 | Redford | B65D 11/186 |
| 2022/0267048 | A1* | 8/2022 | Rogers | A47G 29/141 |
| 2022/0275569 | A1 | 9/2022 | Cohen et al. | |

OTHER PUBLICATIONS

Final Office Action dated Sep. 29, 2023 for Design U.S. Appl. No. 29/764,706, filed Dec. 31, 2020.

Amazon.com_Tstorage 45L Plastic Collapsible Storage Laundry Baskets year 2020.

* cited by examiner

EZE-PACK LAUNDRY HAMPER

RELATED APPLICATIONS

The present application claims benefit under 35 U.S.C. 119(e) of U.S. Provisional Application 63/154,900 filed on Mar. 1, 2021, the disclosure of which is incorporated herein by reference.

FIELD

Embodiments of the disclosure relate to providing a laundry hamper that may be folded into a small volume shape for easy shipping, carrying, or storage

BACKGROUND

Laundry hampers are common to almost every household, hotel, and bed and breakfast. The hampers that most people are familiar with are relatively large containers having rigid or semirigid panels that form a bin and enclose a volume of the bin into which dirty laundry is put, and a top cover hinged to one of the panels for easy closing and opening of the bin. Depending on user preference and location where the hamper is used, the side panels may be non-perforated to prevent odors from dirty laundry escaping the hamper or perforated to provide for aeration of the laundry. Foldable hampers may have a bin and cover made from fabric stretched over a collapsible light metal pipe frame.

SUMMARY

An aspect of an embodiment of the disclosure relates to providing a foldable laundry hamper, optionally referred to as an EZE-Pack hamper or simply EZE-Pack, having an expanded, unfolded configuration and a collapsed, folded configuration. EZE-Pack has a bin formed from front and back panels that are hinged to bifold sides that connect the front to the back panels. The front and back panels and bifold sides are formed from rigid or semirigid injection molded plastic. The bifold sides are foldable to collapse EZE-Pack from the unfolded configuration to the folded configuration.

In the folded configuration the front and back panels sandwich between them the folded bifold sides, a bottom "floor" panel, and a hamper cover. The bifold sides are dimensioned so that when folded they leave a hollow located between them and between the front and back panels. The floor panel may be a one piece rigid or semirigid panel that is hinged to one of the front and back panels so that it may be folded back to the panel to which it is hinged and lie sandwiched between the front and back panel when EZE-Pack is in the folded configuration. The cover comprises first and second foldable or detachable sections that are readily unfolded or assembled to form the cover and readily folded or disassembled for storage between the front and back panels in which one of the first or second sections is positioned in the hollow.

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter.

BRIEF DESCRIPTION OF FIGURES

Non-limiting examples of embodiments of the disclosure are described below with reference to figures attached hereto that are listed following this paragraph. Identical features that appear in more than one figure are generally labeled with a same label in all the figures in which they appear. A label labeling an icon representing a given feature of an embodiment of the disclosure in a figure may be used to reference the given feature. Dimensions of features shown in the figures are chosen for convenience and clarity of presentation and are not necessarily shown to scale.

DETAILED DESCRIPTION

Figure 1A:
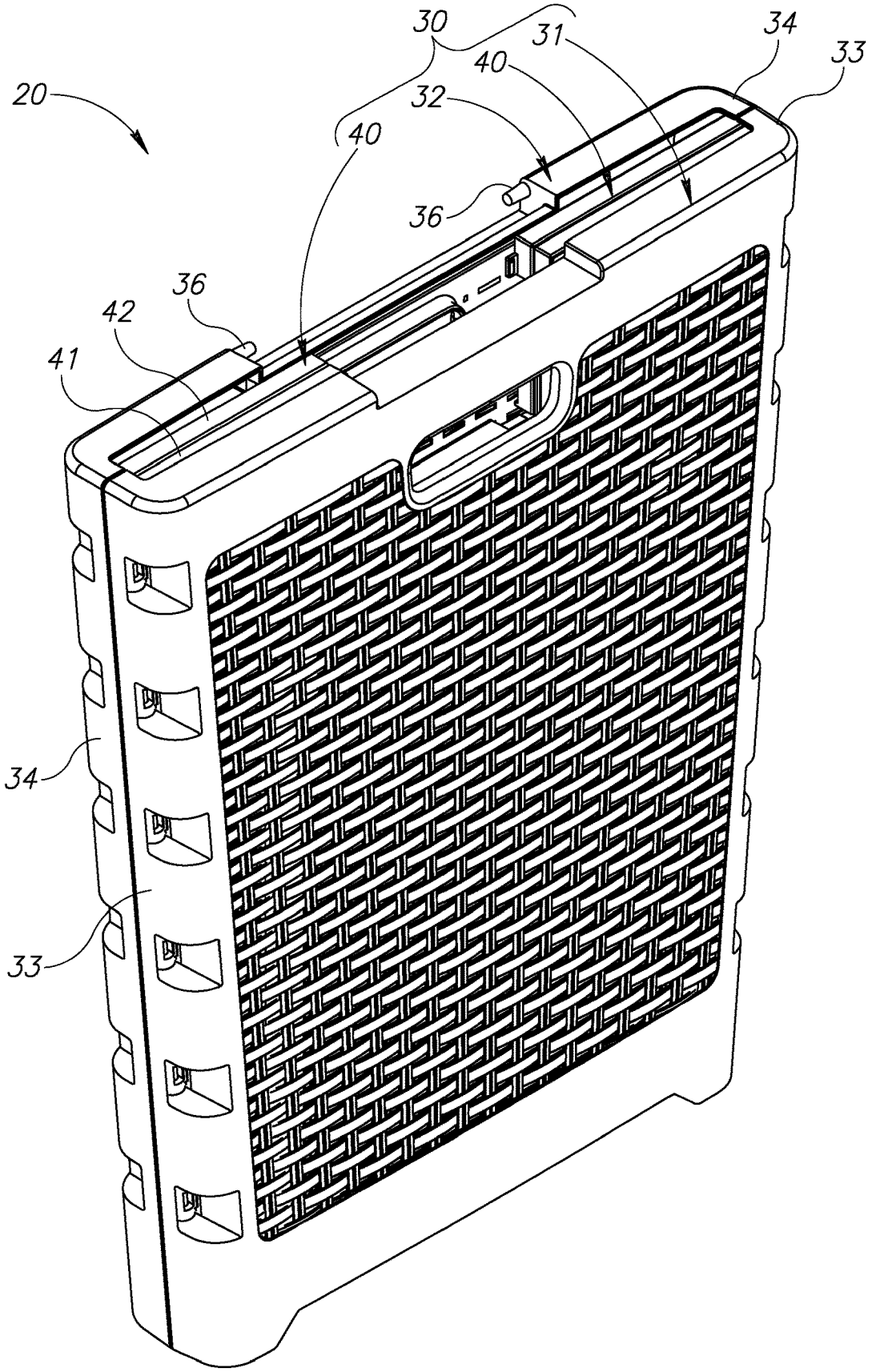
FIG. 1A schematically shows an EZE-Pack hamper in a folded configuration in accordance with an embodiment of the disclosure.

FIG. 1A schematically shows an EZE-Pack hamper 20 in a folded configuration in accordance with an embodiment of the disclosure. EZE-Pack 20 comprises a bin 30 having front and back panels 31 and 32 that are rotatably hinged at respective side edges 33 and 34 to bifold sides 40 having rotatably connected bifold panels 41 and 42, which in FIG. 1A are folded and sandwiched between the front and back panels. In FIG. 1A only the tops of bifold sides 40 are visible. Back panel 32 has two joinder pegs 36 to which a cover discussed below may rotatably be attached.

Figure 1B:
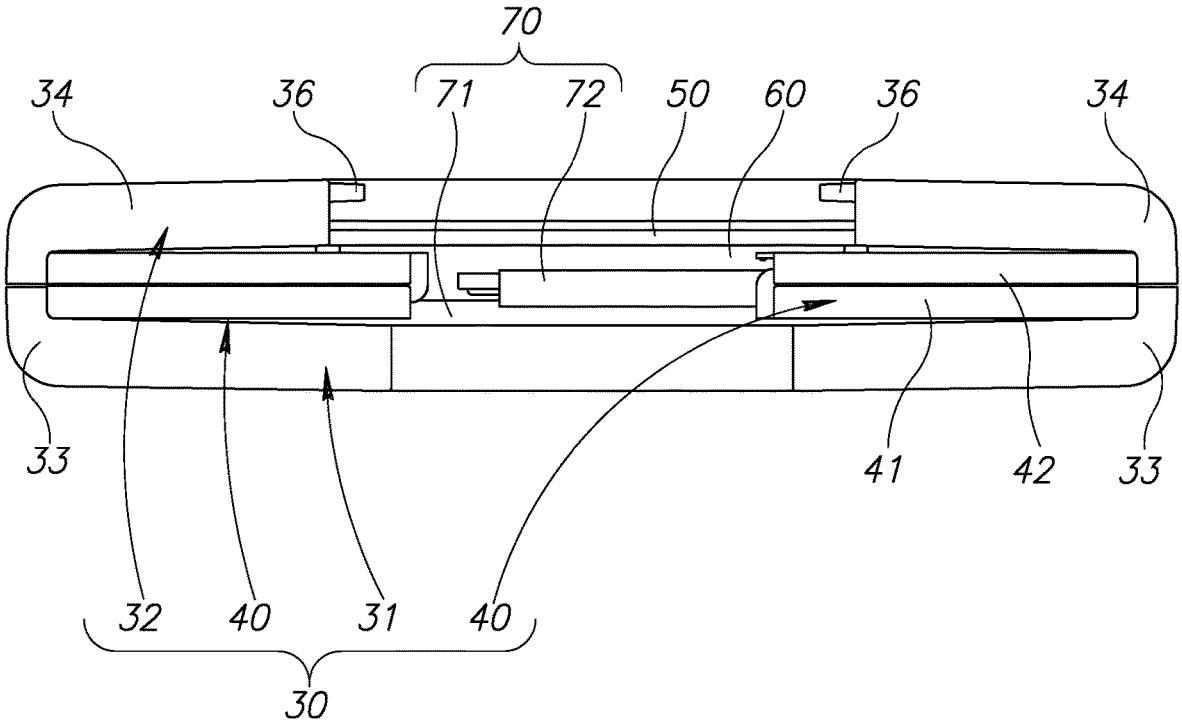
FIG. 1B schematically shows a top view of the EZE-Pack hamper, in accordance with an embodiment of the disclosure.

FIG. 1B schematically shows a top view of EZE-Pack 20 in the folded configuration, in which an edge of a floor panel 50 and edges of separable first and second sections 71 and 72 of a cover 70 of the EZE-Pack are shown in accordance with an embodiment of the disclosure. In the folded configuration floor panel 50 is sandwiched between the front and back panels and lies adjacent to, optionally back panel 32. Bifold sides 40 are dimensioned so that when folded as shown in FIG. 1B they leave a space 60 located between them and between front and back panels 31 and 32. In the folded configuration section 71 and 72 of cover 70 are optionally separated, with first section 71 lying adjacent optionally front panel 31 and second section 72 stored in space 60.

Figure 1C:
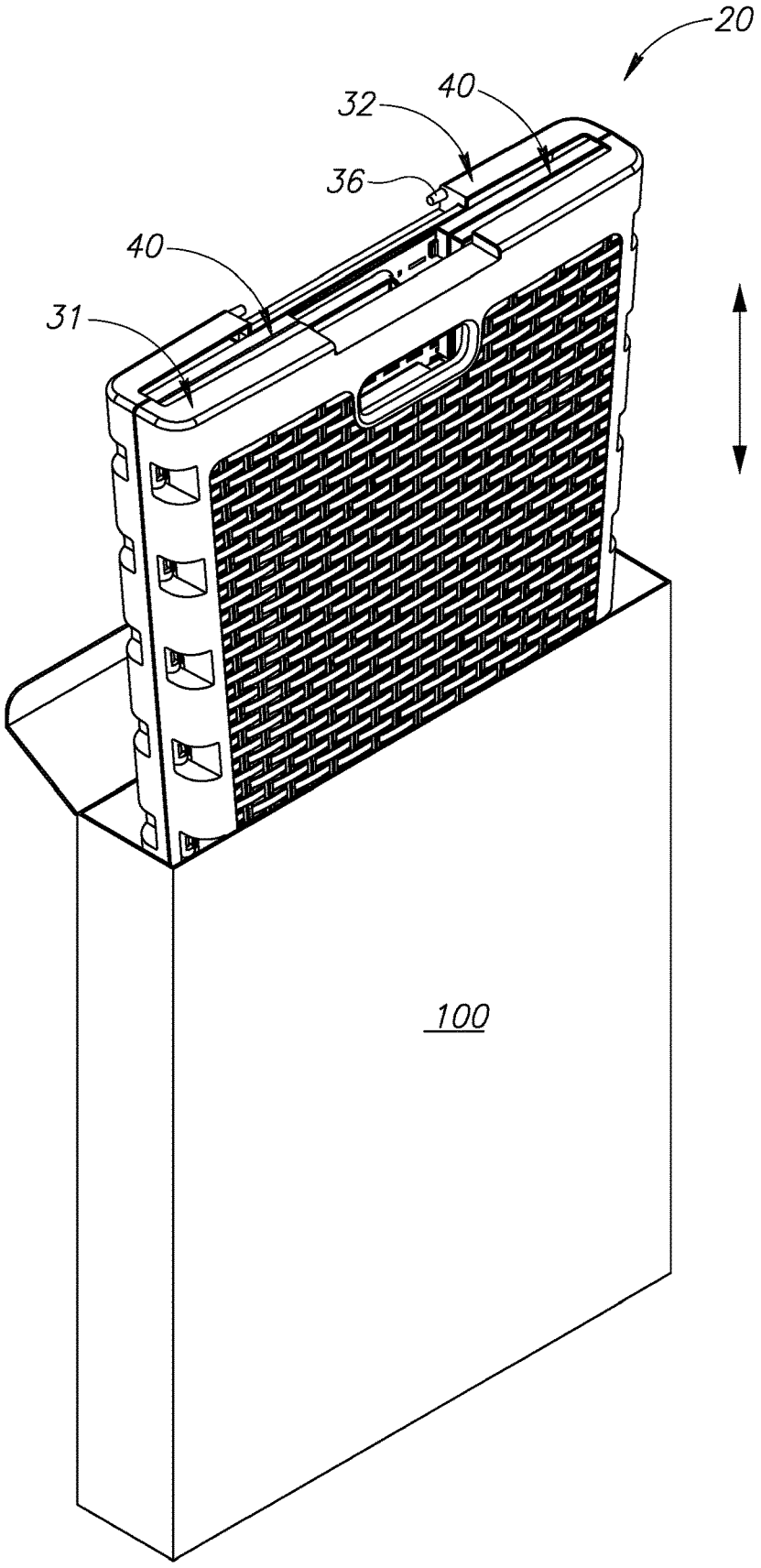
FIG. 1C schematically shows the EZE-Pack hamper being boxed into a narrow shipping carton for easy handling and shipping, in accordance with an embodiment of the disclosure.

The construction of EZE-Pack 20 provides for a folded configuration that securely houses all the components of a large hamper in a relatively small volume that is convenient for shipping. By way of example, FIG. 1C schematically shows EZE-Pack hamper 20 in the folded configuration being inserted into an easily handled, flat and narrow shipping carton 100 that occupies a volume substantially smaller than a volume that EZE-Pack 20 occupies when unfolded.

Figure 2A:
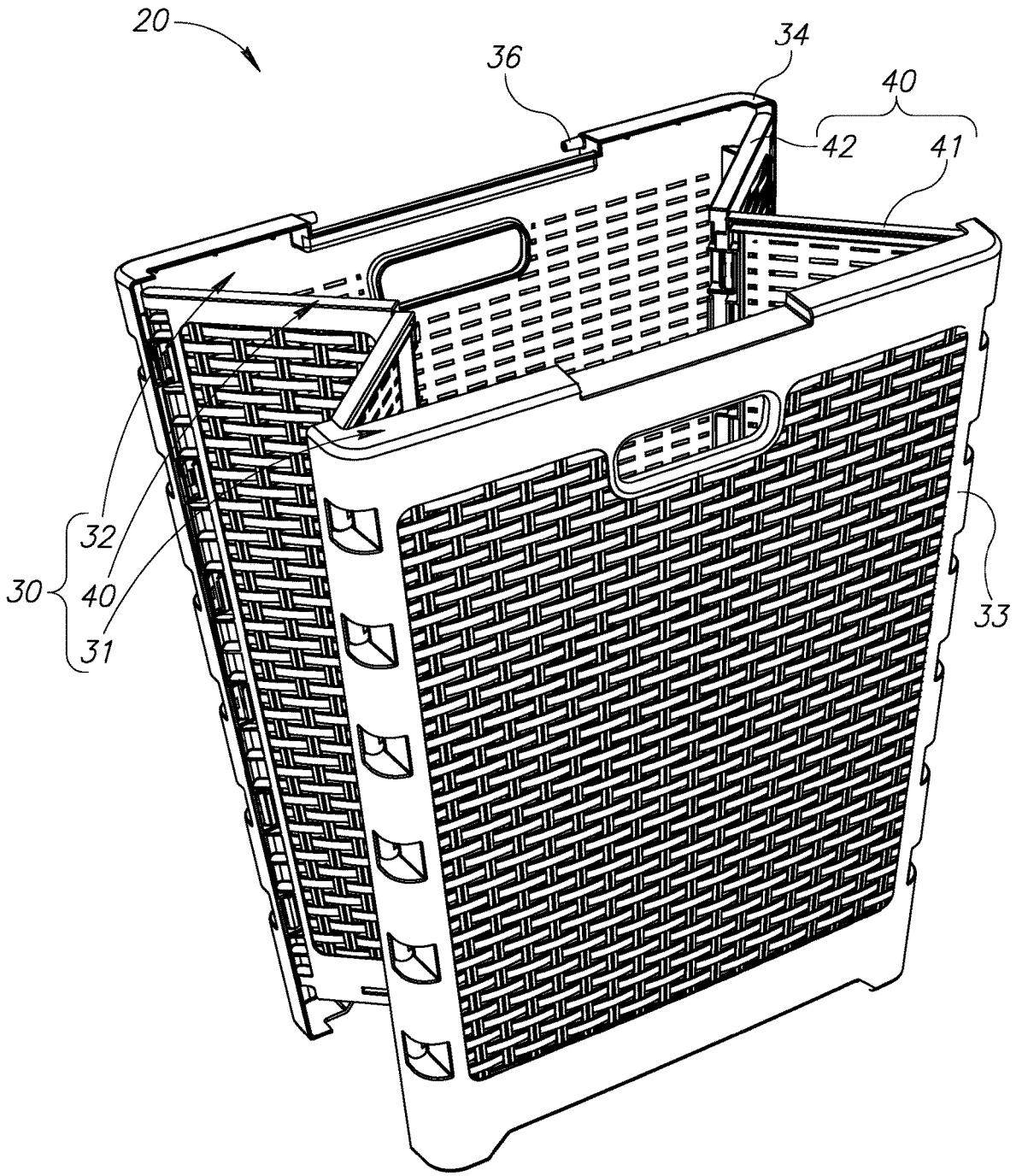
FIG. 2A and FIG. 2B schematically show perspective and top views respectively of the EZE-Pack hamper shown in FIG. 1 partially opened to transition from the folded configuration to the unfolded configuration, in accordance with an embodiment of the disclosure.
Figure 2B:
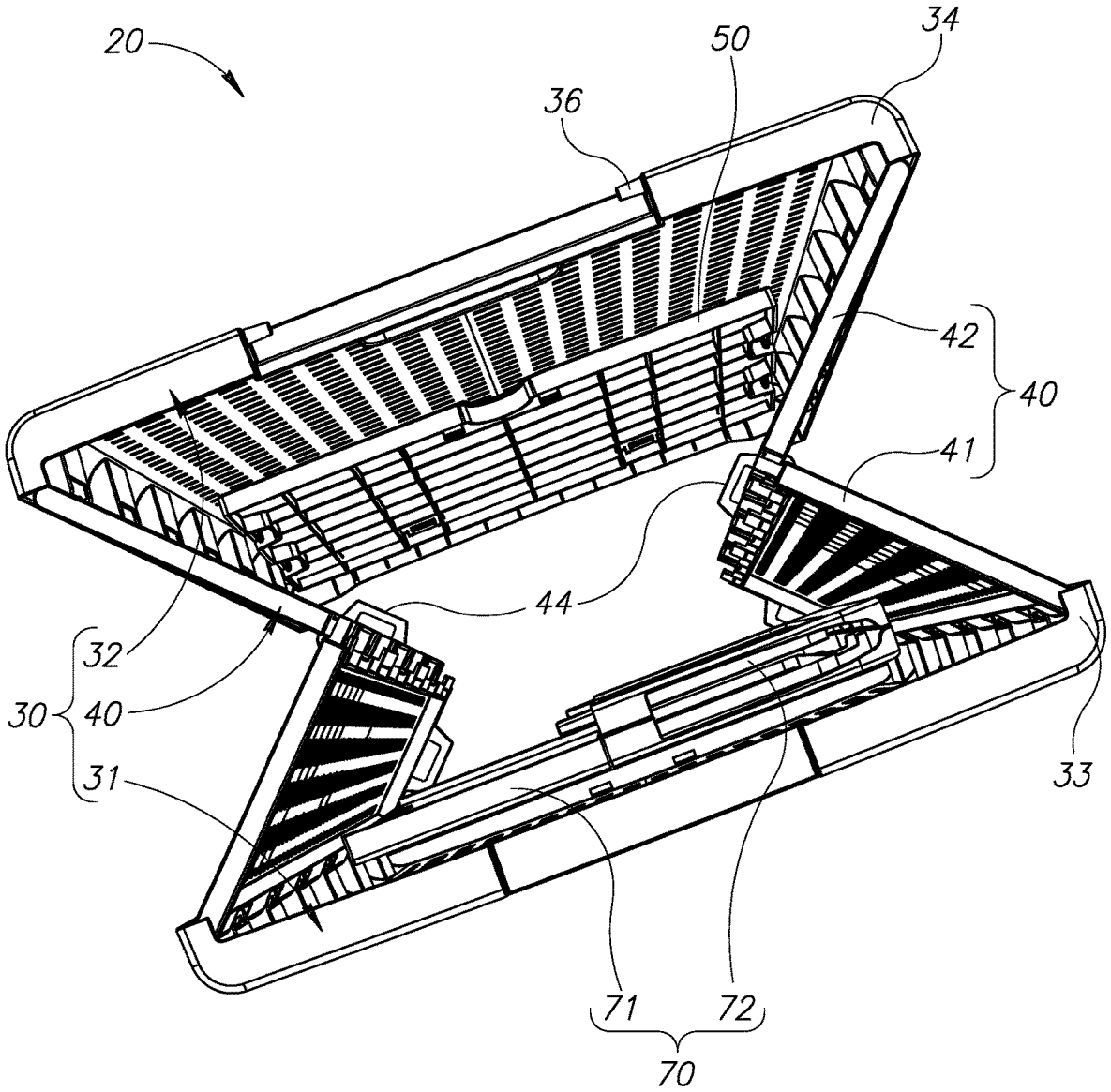
Figure 2C:
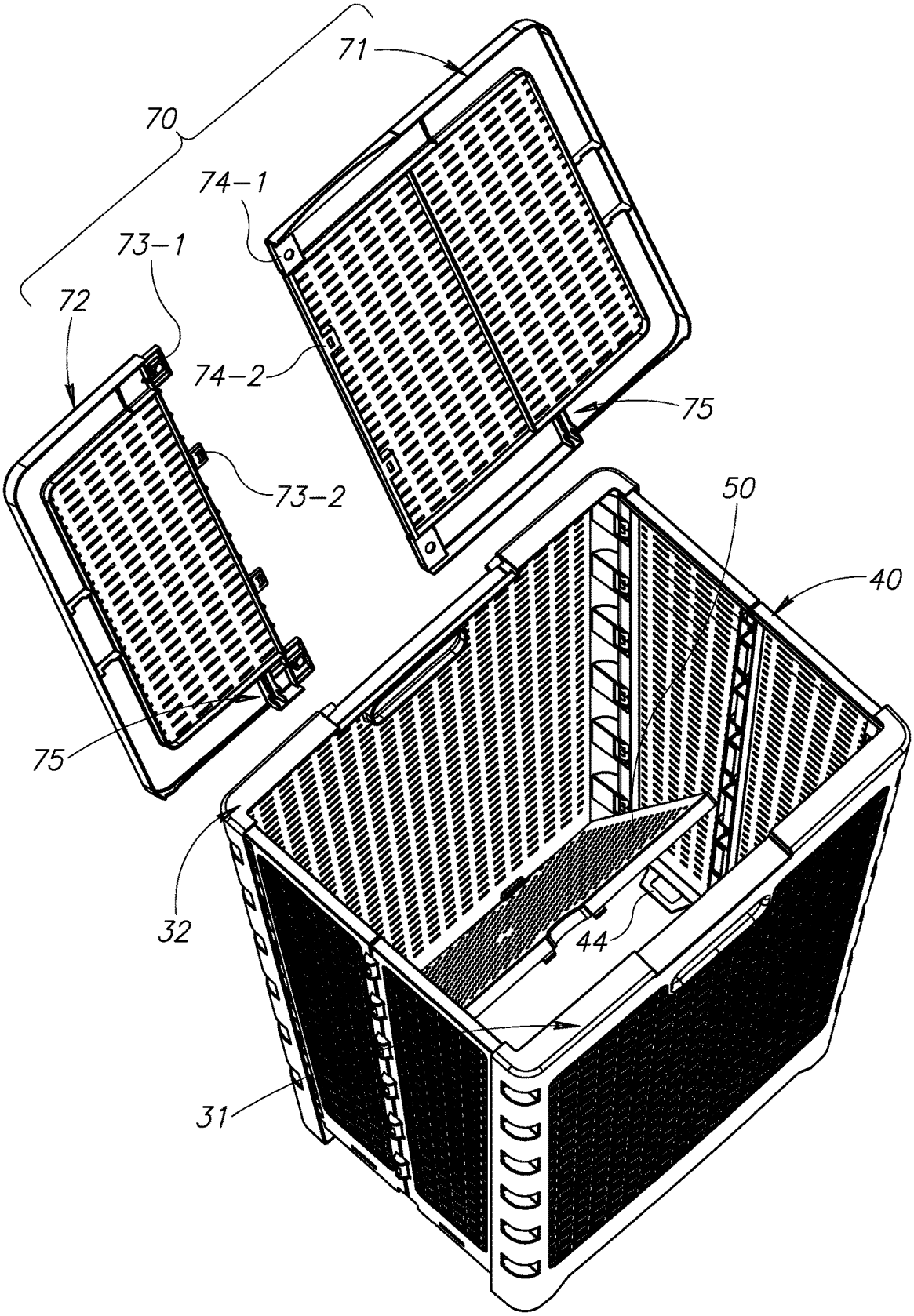
FIG. 2C schematically shows the EZE-Pack hamper shown in FIGS. 2A-2B completely unfolded, first and second sections of the disassembled cover taken out from the hamper, and the floor panel partially rotated away from the back panel to which it is hinged toward its final position to seat at a bottom to the hamper, in accordance with an embodiment of the disclosure.

FIG. 2A schematically shows a perspective view of EZE-Pack 20 partially unfolded. FIG. 2B schematically shows a top view of partially unfolded EZE-Pack 20 in which floor 50 and sections 71 and 72 of cover 70 of EZE-Pack 20 are shown in positions that they occupy when EZE-Pack 20 is in the folded configuration. FIG. 2B also shows floor support brackets 44 which optionally extend from bottom edges of bifold panels 41 and 42 to support floor panel 50 when EZE-Pack 20 is in the unfolded configuration. FIG. 2C schematically shows bifold sides 40 completely unfolded and floor panel 50 partially rotated away from back panel 32 toward a floor position. The figure also shows separable sections 71 and 72 of cover 70, which are optionally designed to be clipped together to form the complete cover, removed from the hamper and not yet assembled. In an embodiment to enable clipping sections 71 and 72 together, section 72 is formed having edge and intermediate coupling nubs 73-1 and 73-2 respectively that may be snapped into corresponding seats or sockets 74-1 and 74-2 respectively in section 71 to secure the two sections together.

Figure 3A:
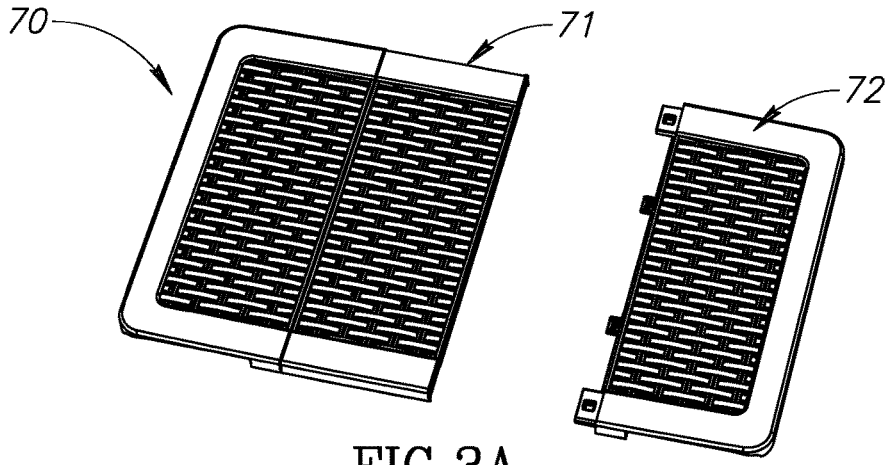
FIGS. 3A-FIG. 3C schematically show assembly of the EZE-Pack cover, in accordance with an embodiment of the disclosure.
Figure 3B:
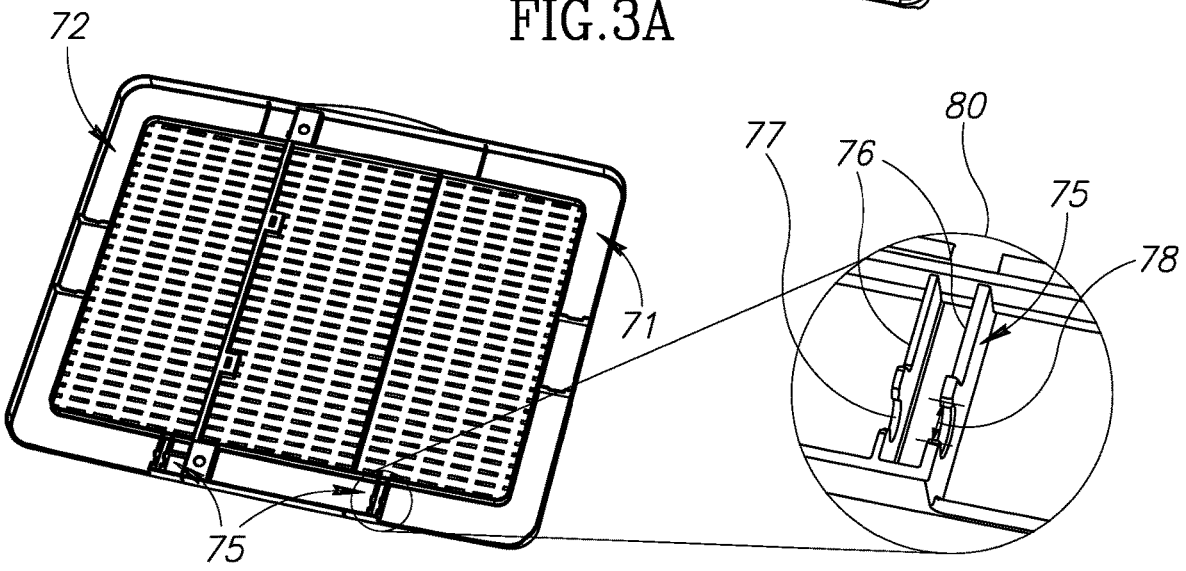
Figure 3C:
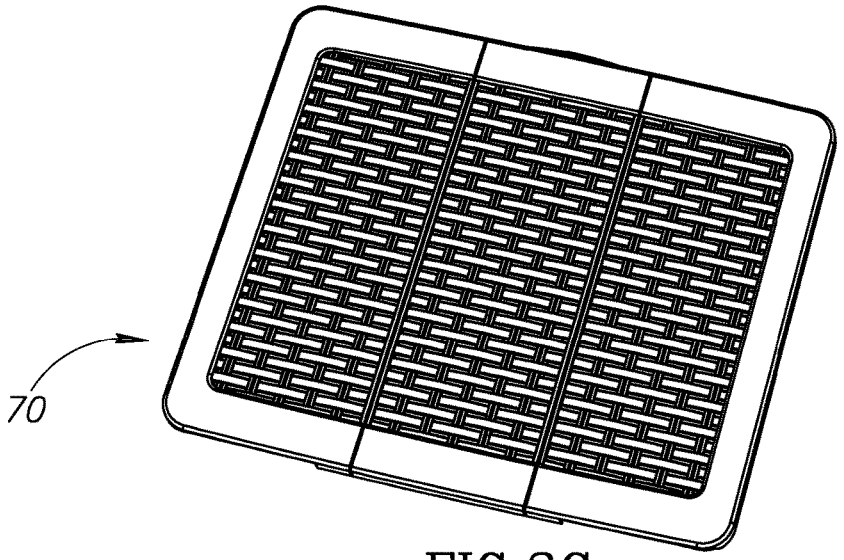

FIG. 3A schematically shows a top view of cover sections 71 and 72 before assembly to form cover 70. FIG. 3B schematically shows a bottom view of completely assembled cover 70. The bottom view shows that each section 71 and 72 has joinder peg snap sockets 75 that are configured to snap onto joinder pegs 36 shown in FIG. 1A to rotatably couple cover 70 to back panel 32 of EZE-Pack hamper 20. A snap socket 75 is shown greatly enlarged in an inset 80. Optionally, each snap socket 75 comprises two parallel snap tongues 76 formed having a hole 77 and narrow access neck 78 for snapping on to a joinder peg 36. FIG. 3C schematically shows a top view of assembled cover 70.

Figure 4:
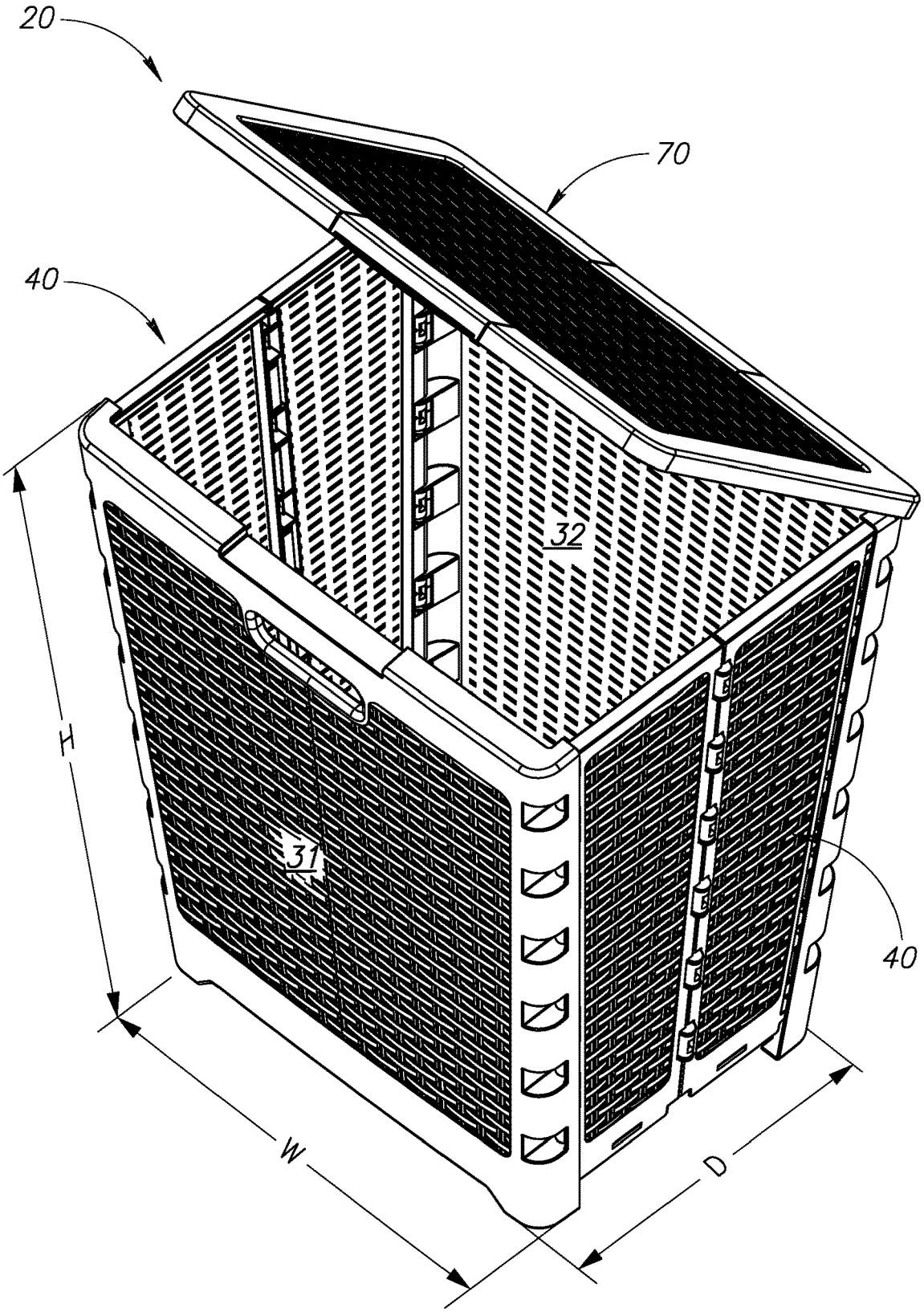
FIG. 4 schematically shows the EZE-Pack hamper completely assembled in the unfolded configuration, in accordance with an embodiment of the disclosure.

FIG. 4 schematically shows EZE-Pack 20 in a fully unfolded configuration with top cover 70 connected to back panel 32 slightly open. By way of a numerical example, in an embodiment, in the unfolded state shown in FIG. 4 EZE-Pack 20 may have a height H equal to about 54 cm (centimeters), a width W equal to about 46 cm, and a depth D equal to about 37 cm. In the folded collapsed state advantageous for shipping shown in FIG. 1A EZE-Pack 20 may have height H equal to about 54 cm, width W equal to about 45 cm and depth D, more appropriately referred to as thickness in the folded state, equal to about 8 cm.

In the description and claims of the present application, each of the verbs, "comprise" "include" and "have", and conjugates thereof, are used to indicate that the object or objects of the verb are not necessarily a complete listing of components, elements or parts of the subject or subjects of the verb. And unless otherwise stated, adjectives such as "substantially" and "about" modifying a condition or relationship characteristic of a feature or features of an embodiment of the disclosure, are understood to mean that the condition or characteristic is defined to within tolerances that are acceptable for operation of the embodiment for an application for which it is intended. In addition the word "or" is considered to be the inclusive "or" rather than the exclusive or, and indicates at least one of, or any combination of items it conjoins.

Descriptions of embodiments of the invention in the present application are provided by way of example and are not intended to limit the scope of the invention. The described embodiments comprise different features, not all of which are required in all embodiments. Some embodiments utilize only some of the features or possible combinations of the features. Variations of embodiments of the invention that are described, and embodiments comprising different combinations of features noted in the described embodiments, will occur to persons of the art. The scope of the invention is limited only by the claims.

The invention claimed is:

1. A foldable laundry hamper having a folded and unfolded state, the hamper comprising: front and back rigid or semirigid panels having a substantially same width;

two bifold sides that are rotatably hinged to the front and back panels, each bifold side comprising first and second bifold panels rotatably connected to be foldable by rotation about an axis and be sandwiched between the front and back panel to fold the hamper from the unfolded state to the folded state, wherein the bifold sides are dimensioned perpendicular to the axis so that when folded they leave a hollow between them and between the front and back panels;

a floor panel rotatably connected to the front or the back panel; and a cover comprising first and second sections;

wherein in the folded state the floor panel is rotated back to the panel to which it is hinged to lie sandwiched between the front and back panel and the second section of the cover lies in the hollow.

2. The laundry hamper according to claim 1 wherein the back panel comprises joinder pegs to which the cover is rotatably attachable.

3. The laundry hamper according to claim 2 wherein the cover comprises a snap socket matched to be snap connected to the joinder peg to rotatably connect the cover to the back panel.

4. The laundry hamper according to claim 3 wherein the snap socket comprises two parallel snap tongues each formed having a hole and narrow access neck for snapping the snap socket to the joinder peg.

5. The laundry hamper according to claim 4 wherein the first section is larger than the second section and in the folded state of the hamper a portion of the first section is sandwiched between the second section and the front or back panel to which the floor panel is not rotatably connected.

6. The laundry hamper according to claim 3 wherein the first and second sections of the cover are detachable from each other.

7. The laundry hamper according to claim 6 wherein the first and second sections of the cover are attachable to each other by clipping a nub located on the first or second section into a seat located on the second or first section respectively.

8. The laundry hamper according to claim 1 wherein the front and back panels, the floor panel, and the cover are formed by injection molded plastic.

* * * * *